US007434741B2

(12) United States Patent
Helt et al.

(10) Patent No.: US 7,434,741 B2
(45) Date of Patent: Oct. 14, 2008

(54) AUTOMATIC DAMPER CONTROL FOR AIR CONDITIONING SYSTEM HUMIDIFIER

(75) Inventors: Robert W. Helt, Tyler, TX (US); Karl J. Mutchnik, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 468 days.

(21) Appl. No.: 10/971,749

(22) Filed: Oct. 22, 2004

(65) Prior Publication Data

US 2006/0086814 A1 Apr. 27, 2006

(51) Int. Cl.

| | |
|---|---|
| ***B01F 3/02*** | (2006.01) |
| ***G05D 21/00*** | (2006.01) |
| ***F24F 3/14*** | (2006.01) |
| ***F25D 17/06*** | (2006.01) |

(52) U.S. Cl. ..... 236/44 R; 236/44 A; 62/91

(58) Field of Classification Search ..... 236/44 A, 236/49.3, 44 R, 44 C; 62/91, 90, 92, 93, 62/176.1, 176.6; 165/222, 223, 229
See application file for complete search history.

(56) References Cited

U.S. PATENT DOCUMENTS

| | | | | |
|---|---|---|---|---|
| 1,751,805 | A | 3/1930 | Fleisher | |
| 1,751,806 | A | 3/1930 | Fleisher | |
| 2,268,769 | A * | 1/1942 | Newton | 62/176.5 |
| 4,382,463 | A * | 5/1983 | Ikebukuro | 165/203 |
| 5,695,116 | A | 12/1997 | Karabin | |
| 6,186,407 | B1 | 2/2001 | Hammer et al. | |
| 6,220,039 | B1 | 4/2001 | Kensok et al. | |

* cited by examiner

*Primary Examiner*—Chen-Wen Jiang
(74) *Attorney, Agent, or Firm*—Wiliiam O'Driscoll

(57) ABSTRACT

A forced airflow air conditioning system includes a humidifier which is operable to humidify air bypassed from a supply air plenum to a return air duct or vice versa, the humidifier airflow being controlled by a damper closure member which is operably connected to a bimetal spring actuator or to an electric motor, both responsive to temperature of air flowing through the system. One embodiment includes an electric motor connected to the damper closure member and in circuit with a humidistat for opening the damper when humidification is required.

17 Claims, 4 Drawing Sheets

AUTOMATIC DAMPER CONTROL FOR AIR CONDITIONING SYSTEM HUMIDIFIER

BACKGROUND OF THE INVENTION

Conventional forced air residential and commercial air conditioning systems often include humidifiers for maintaining proper relative humidity in the system supply air, typically during the heating season in certain climates but also during year-round operation in certain other climates. One widely used type of humidifier is known as a bypass type which is typically configured such that the humidifier unit itself mounts on the system supply air plenum or cabinet, typically downstream of the furnace heat exchanger and the system cooling coil or evaporator. At least a portion of the conditioned air flowing through the plenum is bypassed through the humidifier and through a so-called bypass duct to the return air plenum upstream of the system cabinet. In this way, a suitable pressure differential is maintained by the system blower or fan to provide for air flow through the humidifier.

During operation of the system wherein cooling of the supply air is required, the bypass duct is closed by a manually actuated damper, typically constructed as a butterfly type valve closure member with a manual lever for moving the closure member between open and closed positions. However, the homeowner or system operator often forgets to move the damper to the closed position during operation of the system in periods of ambient climate conditions wherein humidification of the system supply air is normally not required. Thus, there has been a need to provide for automatic control of the damper to provide for closing same when humidification of the supply air flowing through the air conditioning system is not required. It is to these ends that the present invention has been developed.

SUMMARY OF THE INVENTION

The present invention provides an air conditioning system humidifier including an automatically controlled damper whereby, when flow of air through the humidifier is not required, it is automatically shut off by a movable closure member that substantially prevents airflow through the humidifier.

In accordance with one aspect of the present invention, a humidifier for an air conditioning system includes a damper operable to control airflow through the humidifier and which is responsive to a predetermined temperature in the system supply air to move from a closed position to an open position. For example, when the system supply air is being heated during operation of the system furnace or heating element, a sensor is operable to move the damper to an open position since humidification of the heated air will usually be required. One preferred embodiment of a sensor and damper actuator is provided wherein the damper comprises a closure member having a shaft part connected to a bimetallic sensor and actuator which, in response to a predetermined increase in supply air temperature, will move the damper closure member from a closed position to an open position. The sensor and actuator is preferably disposed in the supply air flowstream at a location downstream of the system furnace or heating element. When the supply air temperature is reduced below a predetermined value, the sensor and actuator will effect movement of the closure member back to the closed position.

In accordance with another aspect of the invention, a damper control for a humidifier is provided wherein a motor is connected to the damper closure member and operably connected to a temperature sensor which senses the supply air temperature and provides, at a predetermined temperature, a signal to the motor to move the closure member from a closed position to an open position. When the temperature of the supply air in the plenum decreases below a predetermined value, the motor is de-energized and biasing means, such as a torsion spring, may be operable to move the damper back to a closed position.

In accordance with yet a further aspect of the present invention, a humidifier for an air conditioning system is provided with a damper control comprising a motor for moving the damper between open and closed positions and which motor is controlled in response to a signal from a humidity sensor. The humidity sensor may also be operable to provide a signal to initiate operation of the humidifier, such as by opening a water supply valve. In this way, the humidifier is controlled to begin supplying water to the humidifier element simultaneously with movement of the airflow damper from a closed position to an open position.

Those skilled in the art will further appreciate the above-mentioned advantages and superior features of the invention together with other important aspects thereof upon reading the detailed description which follows in conjunction with the drawings.

DETAILED DESCRIPTION OF THE PREFERRED EMBODIMENTS

Figure 1:
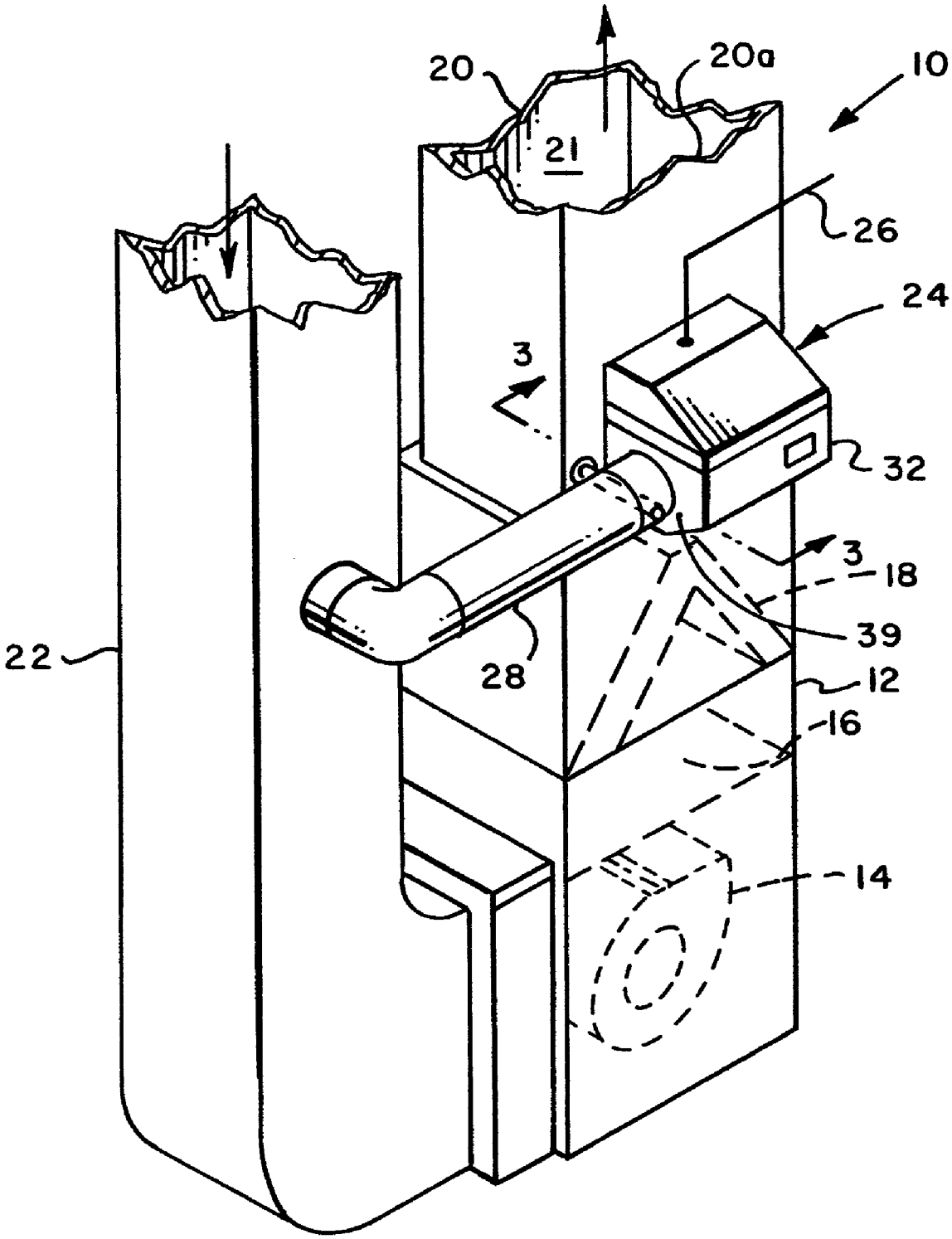
FIG. 1 is perspective view of a conventional forced air type air conditioning system including a bypass type humidifier having an airflow damper in accordance with one preferred embodiment of the present invention.

In the description which follows like parts are marked throughout the specification and drawings with the same reference numerals, respectively. The drawing figures may not necessarily be to scale and certain elements and features may be shown in generalized or somewhat schematic form in the interest of clarity and conciseness.

Referring to FIG. 1, there is illustrated a generally conventional forced air upflow air conditioning system 10 typical of forced air residential heating and cooling systems. The air conditioning system 10 is characterized by a generally rectangular hollow cabinet 12 in which is disposed a motor-driven fan or blower 14, above which may be disposed a heat exchanger 16, such as a gas furnace or an electric grid resistance heater. Also disposed in the cabinet 12 and generally above the heat exchanger 16 is a fin and tube type heating and/or cooling heat exchanger 18 of the so-called A-frame configuration and typically characterized as an evaporator and/or condenser coil for a vapor compression type refrigeration circuit. The heat exchanger 18 may, in a heat pump type system, comprise a heating element for heating air flowing generally upward through the cabinet 12. So-called supply air is discharged from the cabinet 12 through a plenum 20 for distribution to an interior space, not shown, by way of a conventional system of ductwork or the like, also not shown. So-called return air is supplied to the cabinet 12 through a return air duct 22 also in a conventional manner known to those skilled in the art.

In many applications of forced airflow air conditioning systems for residential and commercial buildings, control of the humidity of the conditioned air is desirable. In this regard, the system 10, for example, includes a humidifier, generally designated by the numeral 24, which is mounted on the plenum 20 and is supplied with pressure water by way of a conduit 26 and a suitable control valve, not shown in FIG. 1. In operation of the humidifier 24, a portion of air flowing through the plenum 20 flows through the humidifier and through a bypass duct 28 to the return air plenum or duct 22. Flow of air through the humidifier 24 and the duct 28 is controlled by a damper or butterfly valve type closure member 30, see FIG. 2.

Figure 2:
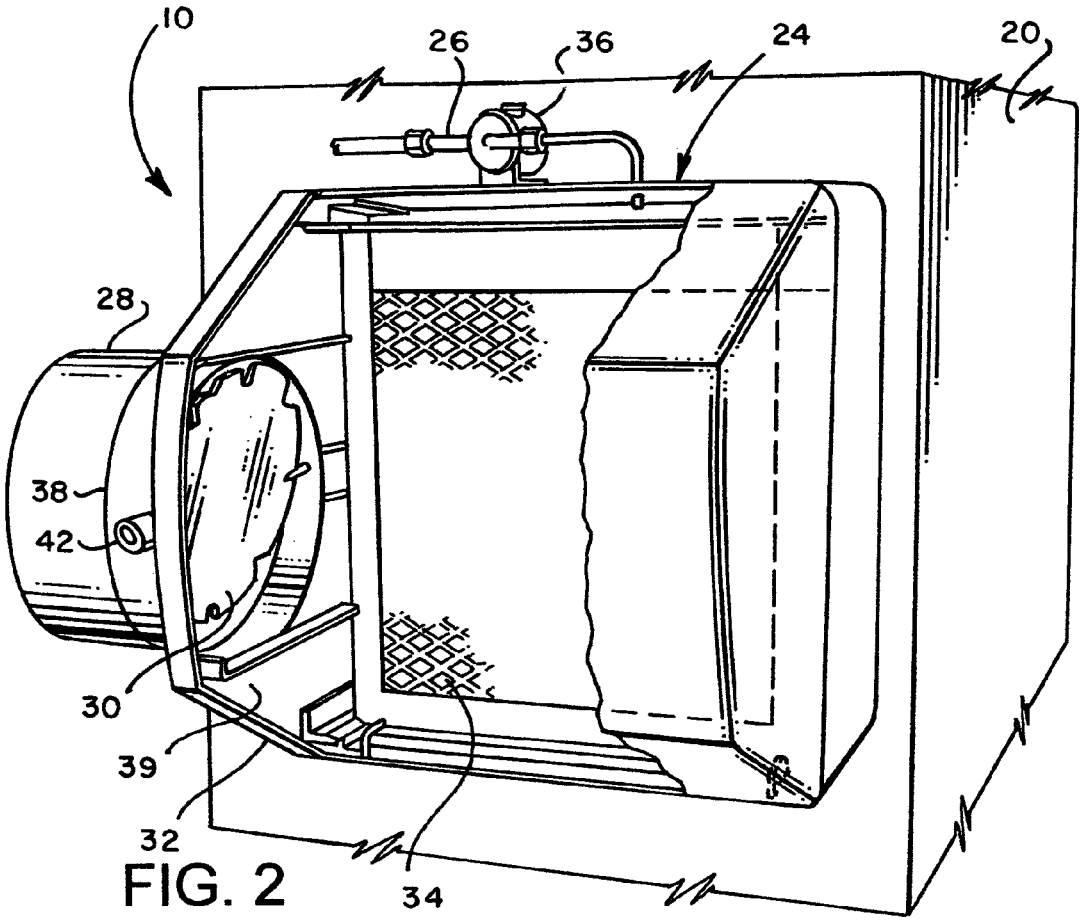
FIG. 2 is a perspective view of the humidifier shown in FIG. 1 with a portion of the humidifier housing removed to show certain features, including the bypass airflow damper.
Figure 3:
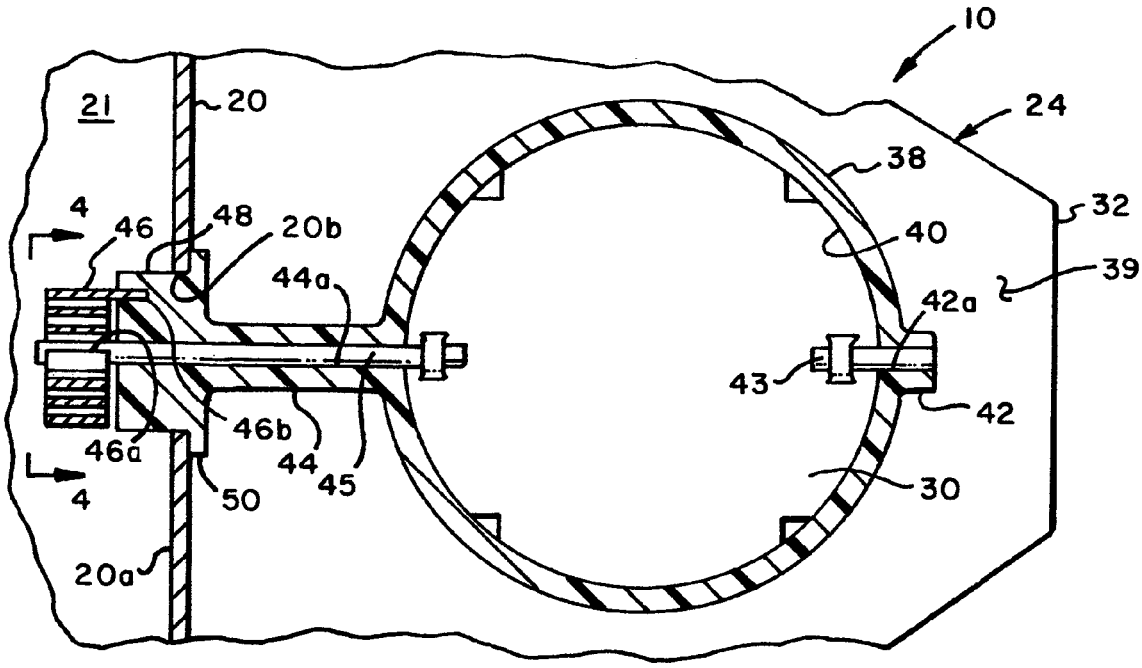
FIG. 3 is a section view taken generally from the line 3-3 of FIG. 1.

Referring to FIG. 2, the humidifier 24 is characterized by a somewhat trapezoidal shaped housing 32, a major portion of which is broken away in the drawing figure to show a foraminous water supporting element 34, and a water supply control valve 36 connected to conduit 26. The bypass damper or closure member 30 is shown in a substantially closed position and is mounted within a generally cylindrical housing part 38 formed integral with housing sidewall 39 and comprising part of the housing 32. Housing part 38 is suitably connected to one end of duct 28. The damper 30 and housing part 38 may be disposed remote from housing 32, such as at an intermediate or opposite end location in or connected to duct 28. The closure member 30 is characterized as a circular disk or butterfly closure member disposed within an opening 40 formed by the housing part 38, see FIG. 3 also. As shown in FIG. 3, the housing part 38 may include opposed bosses 42 and 44 provided with coaxial bearing bores 42*a* and 44*a* for receiving cylindrical shaft parts 43 and 45, respectively, which are suitably secured to the closure member 30 and operable to support the closure member within the opening 40 for rotation about the central axes of the shaft parts 43 and 45 between open and closed positions.

Conventional humidifiers similar to the humidifier 24 are commercially available, such as from the assignee of the present invention and from Research Products Corp. of Madison, Wis. However, the damper position control for conventional humidifiers is a manually actuatable lever connected to one support shaft for the closure member 30 so that the closure member 30 is only moved between open and closed positions in response to manual operation. Typically, the damper closure member 30 is moved to the open position at the onset of the heating season and to the closed position during cooling operation of the system 10. This chore is, as one might expect, often overlooked. Accordingly, substantially automatic control of the position of the closure member 30 is desirable.

Figure 4:
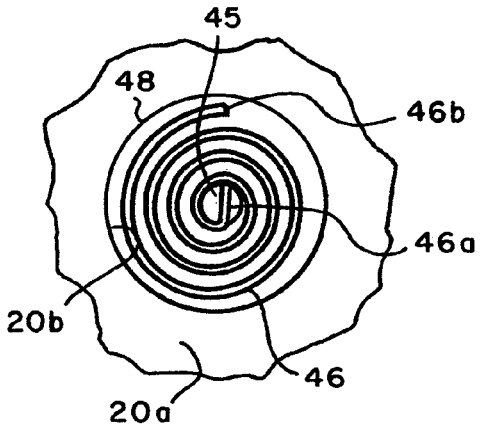
FIG. 4 is a detail view taken generally from the line 4-4 of FIG. 3.

Referring further to FIGS. 3 and 4, in one preferred embodiment of the invention the closure member 30 is operably connected to a "motor" or actuator comprising a bimetallic coil 46 connected to the shaft 45 at 46*a* at one end and to an enlarged diameter part 48 of boss 44 at the opposite end, as indicated by numeral 46*b*. The bimetallic actuator coil 46 may be of a conventional type which is responsive to temperature of air flowing through the system 10, such as through the interior space 21 of plenum 20, FIGS. 1 and 3, for moving the closure member 30 between open and closed positions. As shown in FIG. 3, the enlarged diameter part 48 of boss 44 includes a generally cylindrical flange 50 for securement to the wall 20*a* of the plenum 20. Accordingly, when the humidifier unit 24 is mounted on the plenum 20, a suitable opening 20*b* is provided in the plenum wall 20*a* for receipt of the boss part 48 and the bimetallic actuator or motor 46. The actuator 46 may be designed to effect rotation of the shafts 43 and 45 to move the closure member 30 from a closed position to an open position when the temperature of air flowing through the space 21 reaches a predetermined temperature, about 90° F., for example. In this way, the closure member 30 is automatically moved to an open position during operation of the system 10 to heat the supply air flowing through the plenum 20 and being returned to the space, not shown, which is being conditioned by the system 10. In other operating conditions below 90° F. temperature in the space 21, the closure member 30 is substantially in a closed position to prevent air recirculating from space 21 to the duct 22 by way of the duct 28.

As shown in FIG. 4, the bimetallic type actuator 46 is of somewhat conventional design and is characterized as a spiral coil spring-like element. Those skilled in the art will recognize that possibly other temperature responsive actuators, such as fluid filled bellows, may be utilized for moving the damper closure member 30 between open and closed positions in response to the temperature of air flowing through the space 21 and wherein such actuators may or may not otherwise be provided with an external source of power.

Figure 5:
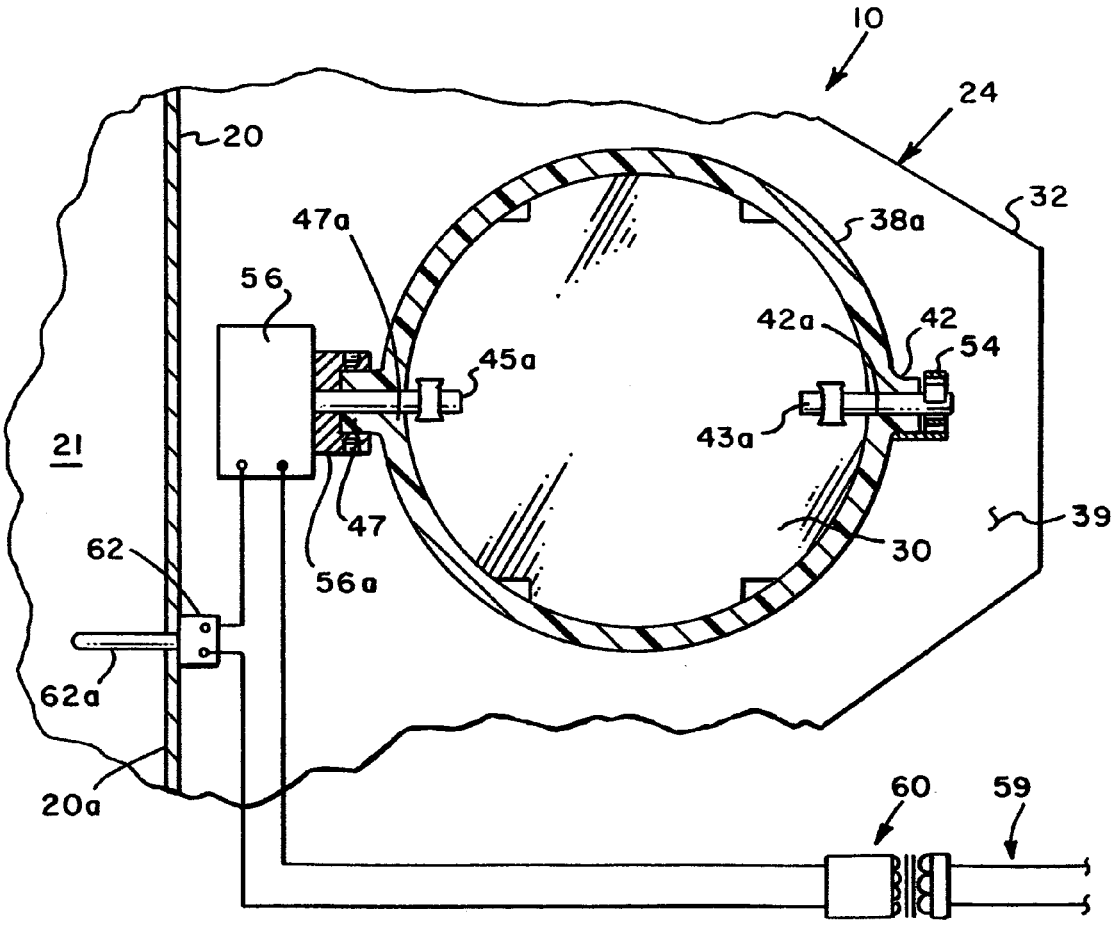
FIG. 5 is a view taken generally from the same perspective as the view of FIG. 3 and illustrating another preferred embodiment of the invention.

Another preferred embodiment of the present invention is illustrated in FIG. 5. Referring to this drawing figure the closure member 30 is supported on a modified housing part 38*a* of housing 32 which has opposed bosses 42 and 47 providing respective bearing bores 42*a* and 47*a* for supporting opposed trunnions or shaft parts 43*a* and 45*a*. Shaft or trunnion 43*a* is connected to a torsion coil spring 54 which is also anchored to the boss 42 and is operable to bias the closure member 30 in a closed position to substantially prevent airflow through the duct 28. Shaft 45*a* is operably connected to a low voltage electric motor 56 which, when energized, overcomes the bias of spring 54 and rotates the closure member 30 to an open position. Motor 56 includes a mounting boss 56*a* operable to mount the motor directly on boss 47, as shown in FIG. 5. Motor 56 is in circuit with a suitable source of electric power 59, including a transformer 60, and which may include other circuitry to be compatible with the operation of the motor 56. The motor control circuit also includes a temperature sensor and switch 62, as shown in FIG. 5, which comprises a sensor element 62*a* operable to sense the temperature of air flowing through the space 21. Accordingly, in the embodiment illustrated in FIG. 5, when the temperature of air flowing through the space 21 reaches a predetermined value, such as 90° F., the temperature sensor and switch 62 is operable to energize the motor 56 to move the closure member or damper 30 to an open position to allow air to be bypassed from space 21 through the humidifier 24 to the return duct 22. Typically, the humidifier 24 is connected to a humidity sensor or humidistat for sensing the humidity in the space controlled by the air conditioning system 10 and for controlling operation of the control valve 36 to provide water flow to the element 34. Accordingly, the damper closure member 30 may operate independent of whether or not the humidifier is actually providing humidification of air flowing through the element 34 in the embodiment according to FIG. 5. However, in many climates humidification of conditioned air is not required except in the heating mode of system 10. Accordingly, a humidifier damper control in accordance with the embodiment of FIG. 5 is suitable for such system applications.

Figure 6:
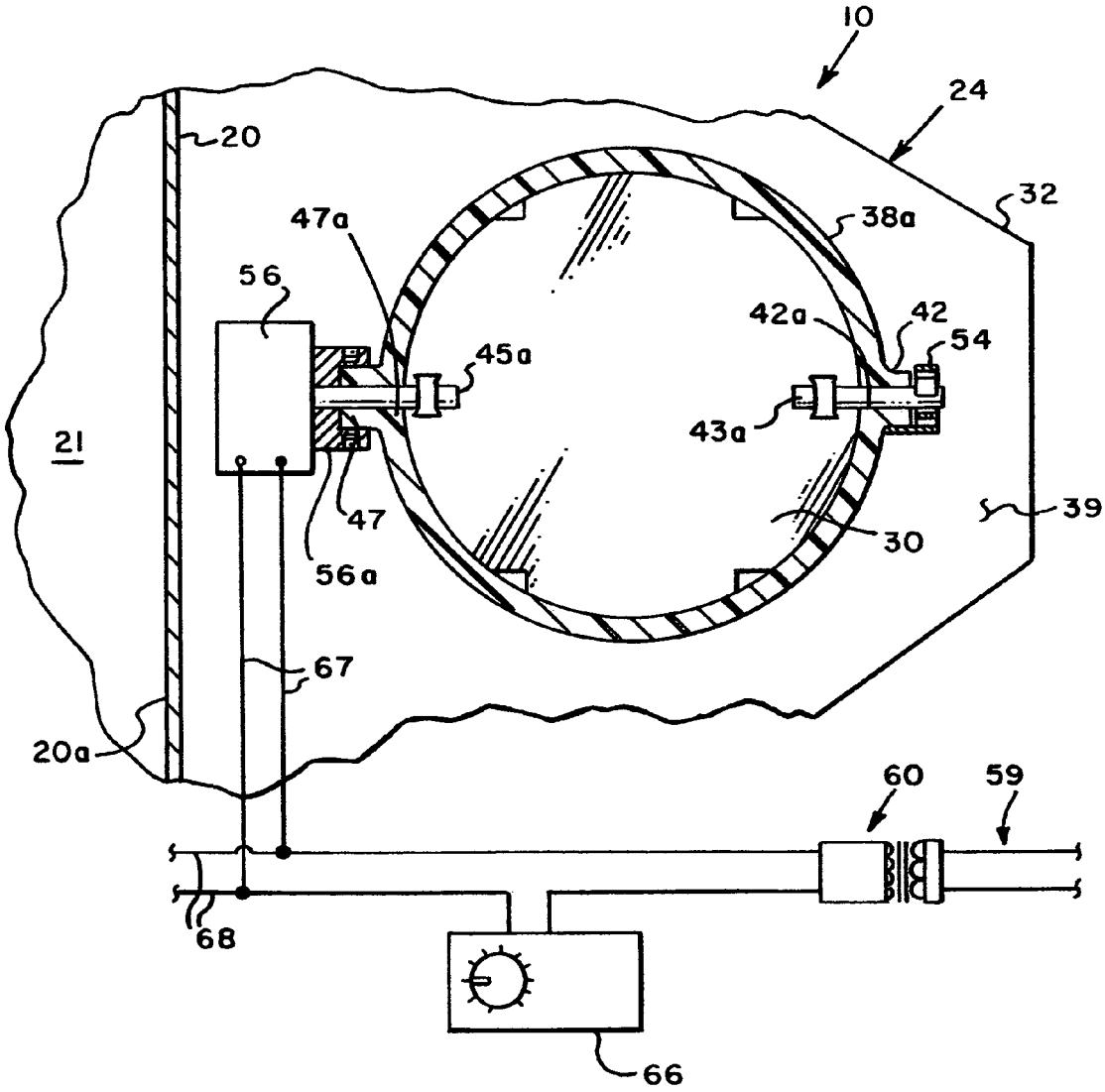
FIG. 6 is a view taken generally from the same perspective as the view of FIG. 3 and showing yet another preferred embodiment of the present invention.

Referring now to FIG. 6, another preferred embodiment of the invention is illustrated and is similar to the embodiment of FIG. 5 except the motor 56 is in circuit with a humidity sensor or humidistat 66 which is also operable to control operation of the water supply valve 36. As shown in the diagram of FIG. 6, low voltage A/C power may supplied via transformer 60 to the motor 56 via other circuitry, not shown, if required, and via conductors 67 power is supplied simultaneously via conductors 68 to the control valve 36. In this way, the motor 56 operates to open the closure member 30 only when humidification of air being conditioned by the system 10 is required. The motor 56 may be of a type which is operable to be energized continuously at a stalled or locked rotor condition. Such motors are commercially available. Only simplified circuitry is shown for providing power to the motor 56 and any other requisite circuitry for the motor is believed to be within the purview of one skilled in the art. Moreover, motor mounting arrangements may vary depending on the specific configuration of the humidifier and the location of the damper or closure member 30 for controlling the airflow through the humidifier.

The configuration of and location of the humidifier 24 in the air conditioning system 10 is exemplary. Horizontal flow and downflow type air conditioning systems may also enjoy the benefits of the invention. The humidifier may include a motor driven fan and be arranged to force humidified air to flow from the return duct to the supply air plenum, for example. Also, it is contemplated that other types of humidifiers may include the features of the invention, including those which control airflow therethrough so that, essentially, air only flows through the humidifier when the humidifier is operating or the air conditioning requirements of the space being treated by the system are likely to require humidification. For example, in certain climates, humidification of the air may be required even during the cooling mode of operation, that is, when only the heat exchanger 18 is operable and is cooling air circulating through the cabinet 12. In this regard, the temperature setting of the actuator 46 or the sensor 62 may be modified as needed, or the embodiment of FIG. 6 may be used for such applications.

Construction, installation and operation of the disclosed embodiments of the damper controls for the damper closure member 30 are believed to be understandable to those of ordinary skill in the art based on the foregoing description. Conventional engineering materials and practices may be utilized to provide the components of the embodiments illustrated in the drawings and described above. However, those skilled in the art will also recognize that various substitutions and modifications may be made without departing from the scope and spirit of the appended claims.

What is claimed is:

1. In an air conditioning system including a supply air plenum, a cabinet including a heat exchanger and a return air duct for returning air from an enclosed space to said system for treatment thereby, said system including a humidifier for humidifying at least a portion of air flowing through said system and through said humidifier, the improvement characterized by:

a damper comprising a movable closure member for controlling the flow of air through said humidifier, and motor means operably connected to said closure member for moving said closure member to a position to allow airflow through said humidifier under a preselected operating condition of said system wherein said motor means comprises an actuator having a bimetal spring element responsive to the temperature of air flowing through system.

2. The invention set forth in claim 1 wherein:

said actuator is operably connected to a shaft connected to said closure member for rotating said closure member between open and closed positions.

3. The invention set forth in claim 2 wherein:

said closure member comprises a generally cylindrical plate-like member mounted on a housing part of said humidifier.

4. The invention set forth in claim 1 wherein:

said actuator is disposed in a space defined by said plenum from which supply air also flows to said humidifier and to a bypass duct when said closure member is in an open position.

5. The invention set forth in claim 1 wherein:

said motor means comprises an electric motor operably connected to said closure member for moving said closure member between open and closed positions.

6. The invention set forth in claim 5 wherein:

said motor is operably connected to an electrical circuit including a temperature sensor for sensing the temperature of air flowing through said system.

7. The invention set forth in claim 6 wherein:

said temperature sensor is disposed in said plenum.

8. The invention set forth in claim 5 wherein:

said motor is in circuit with a control system including a humidity sensor and said motor is operable to provide movement of said closure member to an open position of said damper when said humidity sensor provides a signal which is also operable to effect operation of said humidifier.

9. The invention set forth in claim 8 wherein:

said control system is configured such that said motor is energized when said humidity sensor energizes a control valve for supplying water to an element of said humidifier for humidifying air flowing through said humidifier.

10. The invention set forth in claim 5 wherein:

said damper includes biasing means for biasing said closure member to a closed position.

11. In an air conditioning system including a supply air plenum, a cabinet including a heat exchanger and a return air duct for returning air form an enclosed space to said system for treatment thereby, said system including a humidifier for bypassing at least a portion of air flowing through said system to said return air duct by way of said humidifier and a bypass duct, the improvement characterized by:

A damper including a movable closure member for controlling the flow of air through said bypass duct, and motor means operably connected to said closure member for moving said closure member to a position to allow airflow through said humidifier under a preselected operating condition of said system wherein said motor means includes an electric motor in circuit with a control system having a humidity sensor and said motor is operable to provide movement of said closure member to an open position of said damper when said humidity sensor provides a signal which is also operable to effect operation of said humidifier and includes a bimetal spring actuator operably connected to a shaft connected to said closure member for rotating said closure member between open and closed positions and responsive to the temperature of air flowing through said plenum.

12. The invention set forth in claim 11 wherein:

said actuator is disposed in a space defined by said plenum form which supply air also flows to said humidifier and said bypass duct when said closure member is in an open position.

13. The inventions set forth in claim 11 wherein:

said motor means comprises an electric motor operably connected to said closure member for moving said closure member between open and closed positions and said motor is operably connected to an electrical circuit including a temperature sensor for sensing the temperature of air flowing through said plenum.

14. In an air conditioning system including a supply air plenum, a cabinet including a heat exchanger and a return air duct for returning air from an enclosed space to said system for treatment thereby, said system including a humidifier for bypassing at least a portion of air flowing through said plenum to said return air duct by way of said humidifier and a bypass duct, the improvement characterized by:

a damper including a movable closure member for controlling the flow of air to said bypass duct, and motor means operably connected to said closure member for moving said closure member to a position to allow airflow through said humidifier to said return air duct by way of said bypass duct under a preselected operating condition comprising one of a predetermined temperature of air flowing through said plenum and a predetermined level of humidity of air in said space wherein said motor means comprises an actuator having a bimetallic spring element disposed in and responsive to the temperature of air flowing through said plenum, said actuator being operably connected to a shaft connected to said closure member for rotating said closure member between open and closed positions.

15. The invention set forth in claim 14 wherein:

said motor means comprises an electric motor operably connected to said closure member for moving said closure member between open and closed positions, said motor is operably connected to an electrical circuit including one of a temperature sensor for sensing the temperature of air flowing through said plenum, and a humidity sensor for sensing the humidity of air in said space.

16. A humidifier for an air conditioning system operable to humidify at least a portion of air flowing through said system, said humidifier including a housing, a damper mounted on said housing and including a movable closure member for controlling the flow of air through said humidifier, and motor means operably connected to said closure member for moving said closure member to a position to allow airflow through said humidifier under a preselected operating condition comprising one of a predetermined temperature of air flowing through said system and a predetermined level of humidity of air in a space in which air is being conditioned by said system wherein said motor means comprises an actuator having a bimetallic spring element disposed in a flowpath of air flowing through said system and responsive to the temperature of said air flowing through said system, said actuator being operably connected to a shaft connected to said closure member for rotating said closure member between open and closed positions.

17. The humidifier set forth in claim 16 wherein:

said motor means comprises an electric motor operably connected to said closure member for moving said closure member between open and closed positions, said motor is operably connected to an electrical circuit including one of a temperature sensor for sensing the temperature of air flowing through said system, and a humidity sensor for sensing the humidity of air in said space.

* * * * *